United States Patent [19]

Akiba et al.

[11] Patent Number: 4,546,210

[45] Date of Patent: Oct. 8, 1985

[54] LITZ WIRE

[75] Inventors: Yutaka Akiba, Fujisawa; Toshio Futami, Mobara; Teruo Suda, Chiba, all of Japan

[73] Assignee: Hitachi, Ltd., Tokyo, Japan

[21] Appl. No.: 500,903

[22] Filed: Jun. 3, 1983

[30] Foreign Application Priority Data

Jun. 7, 1982 [JP] Japan ..... 57-96124
Jun. 7, 1982 [JP] Japan ..... 57-96125

[51] Int. Cl.[4] ..... H01B 7/02
[52] U.S. Cl. ..... 174/114 R; 174/120 SR
[58] Field of Search ..... 174/113 R, 33, 120 SR, 174/128 BL; 336/222, 227

[56] References Cited

U.S. PATENT DOCUMENTS 4,079,192 3/1978 Josse ..... 174/113 R

FOREIGN PATENT DOCUMENTS 1989 1/1976 Japan ..... 174/120 SR

*Primary Examiner*—A. T. Grimley
*Assistant Examiner*—Morris H. Nimmo
*Attorney, Agent, or Firm*—Antonelli, Terry & Wands

[57] ABSTRACT

A plurality of strands each comprising a conductor covered with an insulating layer and then with an adhesive layer are twisted together and fixed to each other by fusing of the adjacent adhesive layers to form a litz wire which will not be deformed even by an external force.

10 Claims, 10 Drawing Figures

LITZ WIRE

BACKGROUND OF THE INVENTION

This invention relates to litz wires for high-speed drive coils, low-loss coils and so on, and particularly to a litz wire suitable for easy high-precision assembly and automatic production of coils.

The conventional litz wire, as shown by the cross-section of FIG. 1A, is formed of a plurality of strands 3 each of which is composed of a conductor 1 covered with an insulating layer 2, these strands being twisted together and then covered over the peripheral surface with an adhesive layer 4 so as to have a finished external form 5. Therefore, the strands 3 are fixed only by a frictional force due to the twisting and are not particularly fixed firmly. Consequently, when the litz wire is stressed upon coil assembly or the like, the shape of the litz wire is deformed in the manner shown by the cross-section of the wire illustrated in FIG. 1B. Particularly when the number of the strands 3 constituting the litz wire is increased, the frictional force between the strands due to the twisting is decreased so that its cross-sectional shape is easy to be deformed by an external force.

The deformation of the cross-sectional shape of the litz wire makes the high-precision assembly and automatic production of coils difficult, which fact is a serious problem.

FIG. 2 is an external view of a magnetic bubble memory drive coil produced by using the litz wire. FIGS. 3A and 3B show cross-sectional views taken along line 3—3 in FIG. 2, corresponding to the finished external shapes 5 and 6 shown in FIGS. 1A and 1B. If the cross-sectional shape is deformed from a circular to an elliptical shape as shown by the finished external shape 6, the winding density n in a certain coil length (number of turns per unit length) is caused to decrease greatly. Since the inductance L of a coil is proportional to the square of the winding density n, the inductance L is changed greatly by the deformation of the cross-sectional shape.

Therefore, even though the drive coil is designed satisfactorily as shown in FIG. 3A or the structure of the litz wire is designed well as shown in FIG. 1A, change of the cross-sectional shape of the litz wire at the time of assembly and production of coil as shown in FIGS. 1B and 3B will make the coil specification (inductance L with respect to a constant coil shape and so on) difficult to maintain.

On the other hand, in order to reduce the high frequency loss including D.C. loss in the high-speed drive coil for the magnetic bubble memory, generally the conductor diameter of strands 3 is reduced so that the influence of skin effect is also reduced and the number of strands is increased so that the D.C. loss is reduced. In the past years, the request for high speed drive coils with high frequency is not large so that the conductor diameter of the strands is large and thus the number of strands is small, which results in the cross-sectional shape being little deformed and causes no trouble. However, as the request for high-speed drive coil becomes greater it is absolutely necessary to increase the number of strands and as a result the deformation of the cross-sectional shape becomes inevitably important.

SUMMARY OF THE INVENTION

It is an object of this invention to provide a litz wire construction capable of preventing the deformation of its cross-sectional shape.

It is another object of this invention to provide a litz wire suitable for production of coils conforming to a specification required for producing a high speed drive coil.

The feature of this invention is that in order to improve the prior art litz wire with the strands not fixed to each other as shown in FIG. 1A, an adhesive layer is covered on the perpheral surface of each of the individual strands, which are then twisted together to form a litz wire.

DESCRIPTION OF THE PREFERRED EMBODIMENTS

Some embodiments of this invention will be described with reference to the accompanying drawings.

Figure 4:
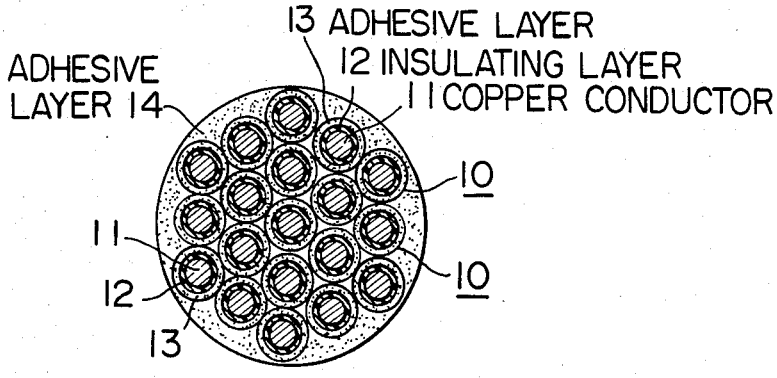
FIGS. 4, 5 and 6 are cross-sectional views of three embodiments of the litz wire according to this invention.

FIG. 4 is a cross-sectional view of a first embodiment of this invention. Referring to FIG. 4, there is shown strands 10 each of which is formed of a copper conductor 11, a polyurethane insulating layer 12 with which the copper conductor is coated, and an adhesive layer 13 of thermoplastic resin covering the outer periphery of the polyurethane insulating layer. A litz wire is formed of a plurality of (in FIG. 4) 19 strands, which are twisted together and heated so that the adhesive layer 13 of thermoplastic resin is softened and fused thereby to fix the strands, and then the fixed strands are covered with a thermoplastic resin adhesive layer 14 over the finished periphery of the fixed strands. According to this embodiment, since the strands are fixed together by the softened and fused first adhesive layer 13, deformation of the shape of the cross-section of the litz wire can be prevented from occurring in the manner shown in FIG. 1B. The second adhesive layer 14 covered over the finished periphery of the strands is used to fix the shape of a coil produced by such litz wire.

Figure 5:
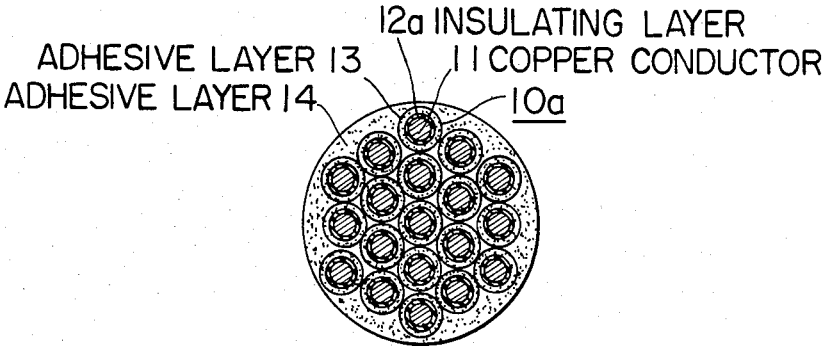

FIG. 5 is a cross-sectional view of a second embodiment of this invention. This second embodiment is different from the first embodiment shown in FIG. 4 in that each strand 10*a* is formed of the copper conductor 11 covered with a polyurethane insulating layer 12*a* of the film thickness according to the third class of the Japanese Industrial Standard (JIS).

The second embodiment is effective to not only prevent the deformation of the cross-sectional shape of the litz wire but also to increase the proportion of the conductor cross-sectional area in the finished cross-sectional area of the litz wire, i.e., the space factor.

Figure 1A:
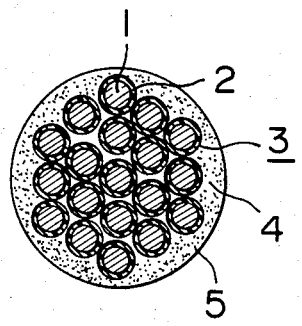
FIG. 1A (PRIOR ART)
FIGS. 1A and 1B are cross-sectional views showing two modes of a conventional litz wire.
Figure 1B:
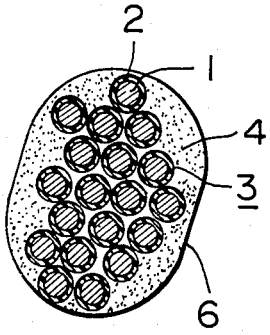
FIG. 1B (PRIOR ART)
Figure 7:
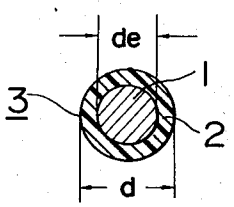
FIG. 7 is a cross-sectional view of a strand.

That is, the insulating layer 2 generally used for the strand 3 of the litz wire as shown in FIG. 1A is upto the third class of the JIS standard. If, as shown in FIG. 7 (the strand 3 is shown magnified), de is the diameter of the conductor 1, and d is the outer diameter of the finished strand 3 formed of the conductor 1 covered with the insulating layer 2, the outer diameter d, using constants B, m associated with the film ratio, is expressed as $$d = B \cdot de^{m}$$

The d of the strand with an insulating layer within the third class is in the range of $$0.93\ de^{0.95} < d < 0.90\ de^{0.88}$$

Figure 8:
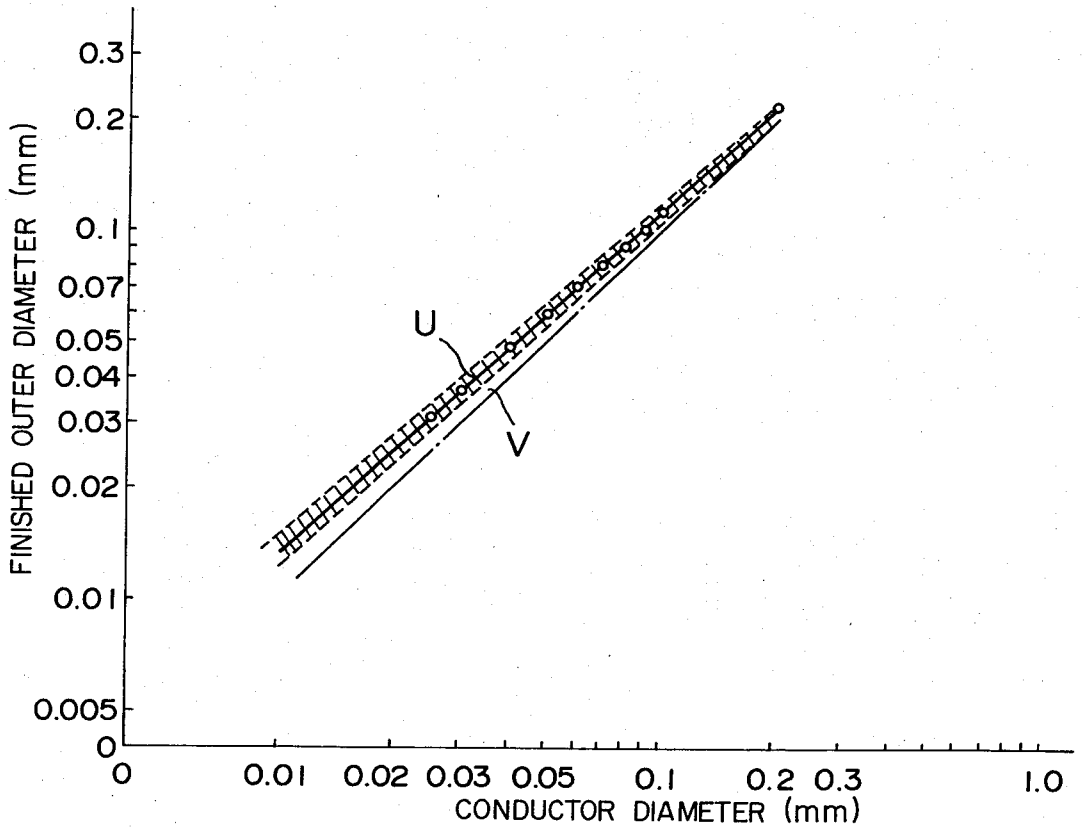
FIG. 8 is a graph showing the relationship between the conductor diameter of a strand and the finished outer diameter thereof.

This range is shown by the shaded area, U in FIG. 8. In FIG. 8, the abscissa indicates the conductor diameter de (mm), and the ordinate is the finished outer diameter d (mm).

In the embodiment of FIG. 5, the film thickness of the polyurethane insulating layer 12*a* is selected to be the value according to the third class of Japanese Industrial Standard (JIS) for the purpose of increasing the space factor, as indicated by the region, V in FIG. 8. In this case, the finished outer diameter d is in the range of $$de < d \leqq 0.93\ de^{0.95}$$

The third class of JIS corresponds practically to the Single Build of NEMA standard in U.S.A. Then, the effect is achieved that the space factor is increased as shown in the second embodiment of the present invention by the use of a strand whose film thickness of insulating layer is less than the value specified in the table of the Single Build of NEMA standard.

Figure 6:
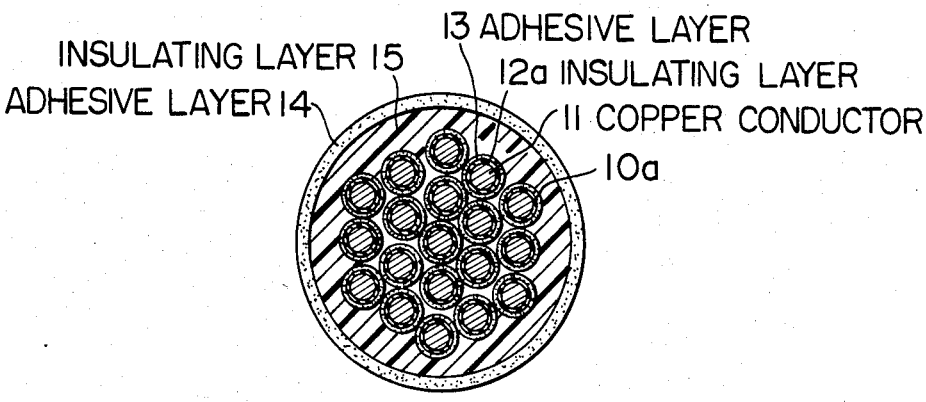

FIG. 6 is a cross-sectional view of a third embodiment of this invention. The strand 10*a* of the third embodiment is formed of the copper conductor 11, the polyurethane insulating layer 12*a* with which the conductor 11 is covered, and the thermoplastic resin adhesive layer 13 covering the outer periphery of the insulating layer 12*a*. The litz wire is produced by twisting a plurality of strands 10, heating them in order to soften and fuse the adhesive layer 13 of thermoplastic resin of each strand thereby to fix the combined strands, and then covering them with a polyester insulating layer 15 and the second thermoplastic resin adhesive layer 14 as shown in FIG. 6. The third embodiment is particularly different from the second embodiment in that the second adhesive layer 14 is applied on the finished outer peripheral portion after the polyester insulating layer 15 is applied. According to this embodiment, deformation of the cross-sectional shape of the litz wire can be prevented as described in the first embodiment, and it is possible to increase the space factor to improve the moisture resistance, the heat resistance and the insulation effect and to reduce the stray capacitance between the windings, as in the second embodiment.

In other words, the moisture resistance and heat resistance can be improved by the two insulating layers in the third embodiment; since the insulating layer 12*a* for one side (strands) is made of polyurethane insulating material excellent in moisture resistance, and the insulating layer 15 for the other side (litz wire) is made of polyester insulating material excellent in heat resistance, both the moisture and heat resistances can be improved.

In the prior art, the insulating layer 2 for strands constituting the litz wire requires a constant film thickness for good reliability and characteristics irrespective of small space factor, but as in the third embodiment of this invention, the structure of two insulating layers enables the insulating layer 12*a* for the strand 10*a* to have a sufficiently small film thickness. This is because the potential difference between strands is substantially zero as a feature of the litz wire and the insulating layer 15 in FIG. 6 completely provides insulation for the litz wire. In addition, the insulating layer 15 which provides a wrapping surrounding the strands contributes to reduction of the stray capacitance between windings and layers when coils are formed.

Figure 2:
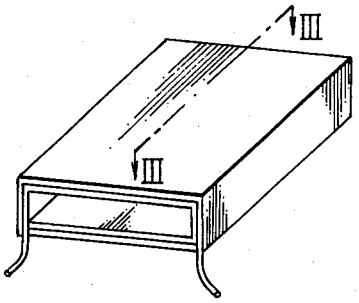
FIG. 2 (PRIOR ART)
FIG. 2 is a perspective view of a magnetic bubble memory driving coil produced by using a litz wire.
Figure 3A:
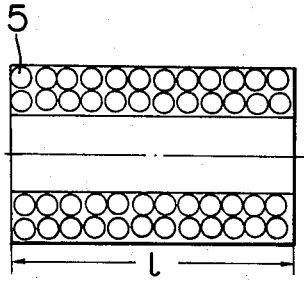
FIG. 3A (PRIOR ART)
FIGS. 3A and 3B are cross-sectional views showing two modes of a cross-section taken along line 3—3 in FIG. 2.
Figure 3B:
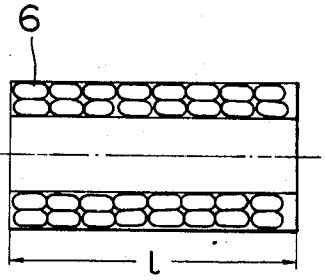
FIG. 3B (PRIOR ART)

When a two-layer coil as shown in FIGS. 2 and 3A is produced by using a litz wire without the insulating layer 15, the gap length Δd between the windings and between the layers is expressed by $$\Delta d = d - de \qquad (1)$$

wherein the diameter of the conductor 1 is represented by de, and the finished diameter of strand 3 by d, and therefore the Δd is determined by the film thickness of the insulating film 2 on the strand 3.

In order to reduce the high frequency loss due to the skin effect and to increase the frequency of the drive current in the coil, it is necessary to decrease the diameter of the strand conductor of the litz wire. The finished diameter d of the strand 3 is expressed by $$d = A\ de \qquad (2)$$

wherein A is the film ratio (>1), the Δd is given from Egs. (1) and (2), as $$\Delta d = (A - 1)\ de \qquad (3)$$

In the litz wire used, the Δd is decreased because the film ratio A is substantially constant with a decrease of the diameter de of the strand conductor. As a result, the drive coil using the litz wire without the insulating layer 15 encounters problems of large high-frequency loss and deterioration of insulation due to the increase of stray capacitance between windings and between layers.

On the contrary, when the film thickness of the insulating layer 2 on the strand 3 is increased in order to increase the gap length Δd between the windings and between layers, the space factor is decreased to increase the D.C. resistance.

In the third embodiment of this invention, however, the stray capacitance is reduced so as not to increase the high-frequency loss and the insulation is improved since the insulating layer 15 is substantially interposed between the windings and between the layers.

I claim:

1. A litz wire formed of a plurality of twisted strands, each of the strands comprising a conductor covered with an insulating layer, wherein said insulating layer of each of said strands is covered over the peripheral surface thereof with a first adhesive layer for effecting adhesion between adjacent strands, and adjacent first adhesive layers are fused together to fix the twisted strands and the plurality of fixed strands is covered with a second adhesive layer; said first adhesive layer comprising a thermoplastic resin and said twisted strands covered with said first adhesive layers being heated so that the first adhesive layers are softened and fused to fix each strand.

2. A litz wire according to claim 1, wherein said second adhesive layer comprises a thermoplastic resin.

3. A litz wire formed of a pluarlity of twisted strands, each of the strands comprising a conductor covered with an insulating layer, wherein said insulating layer of each of said strands is covered over the peripheral surface thereof with a first adhesive layer for effecting adhesion between adjacent strands and the adjacent first adhesive layers are fused together to fix the twisted strands; the film thickness of the insulating layer on each of said strands being selected to provide a finished outer diameter (d) which is defined by $$de < d \leqq 0.93\ de^{0.95}$$

wherein de is the diameter of the conductor.

4. A litz wire comprising:

a plurality of twisted strands, each of said strands comprising a conductor covered over the periphery thereof with a first insulating layer and a first adhesive layer formed over each of said first insulating layers and fused to adjacent first adhesive layers to fix the twisted strands; and a second insulating layer covered on the peripheral surface of a fixed assembly of said plurality of twisted strands.

5. A litz wire according to claim 4, wherein said first adhesive layer comprises a thermoplastic resin and the twisted strands are heated so that each adhesive layer is softened and fused to fix the strands.

6. A litz wire according to claim 4, wherein the film thickness of the first insulating layer on each of said strands, is selected to provide a finished outer diameter (d) which is defined by $$de < d \leqq 0.93\ de^{0.95}$$

wherein de is the diameter of the conductor.

7. A litz wire according to claim 4, wherein said second insulating layer is covered over and outer surface thereof with a second adhesive layer.

8. A litz wire according to claim 7, wherein said second adhesive layer comprises a thermoplastic resin.

9. A litz wire according to claim 4, wherein said conductor is formed of electrically conductive metal.

10. A litz wire according to claim 9, wherein said metal comprises copper.

* * * * *